US009233392B2

(12) United States Patent
Han

(10) Patent No.: US 9,233,392 B2
(45) Date of Patent: Jan. 12, 2016

(54) ARTIFICIAL HAIR FILAMENT HAVING ANTIBACTERIAL AND ANTIFUNGAL PROPERTIES, METHOD AND DEVICE FOR PREPARING THE SAME

(71) Applicants: Selim Fiber Co., Ltd., Gyeonggi-Do (KR); Sang Soon Han, Gyeonggi-Do (KR)

(72) Inventor: Sang Soon Han, Gyeonggi-Do (KR)

(73) Assignees: Selim Fiber Co., Ltd., Gyeonggi-Do (KR); Sang Soon Han, Gyeonggi-Do (KR)

( * ) Notice: Subject to any disclaimer, the term of this patent is extended or adjusted under 35 U.S.C. 154(b) by 179 days.

(21) Appl. No.: 13/770,302

(22) Filed: Feb. 19, 2013

(65) Prior Publication Data

US 2013/0156843 A1 Jun. 20, 2013

Related U.S. Application Data

(63) Continuation-in-part of application No. 13/351,505, filed on Jan. 17, 2012, now abandoned.

(30) Foreign Application Priority Data

Nov. 16, 2011 (KR) ..... 10-2011-0119684

(51) Int. Cl.

| | |
|---|---|
| ***B05D 1/28*** | (2006.01) |
| ***B05D 1/02*** | (2006.01) |
| ***D06M 16/00*** | (2006.01) |

(Continued)

(52) U.S. Cl.

CPC .. *B05D 1/02* (2013.01); *B05D 1/28* (2013.01); *D06B 11/0059* (2013.01); *D06M 16/00* (2013.01); *D06M 23/02* (2013.01); *D06M 23/06* (2013.01); *D06M 23/08* (2013.01); *A41G 3/0083* (2013.01); *D01F 1/103* (2013.01); *D01F 8/06* (2013.01); *D01F 8/12* (2013.01); *D01F 8/14* (2013.01); *D01F 8/16* (2013.01);

(Continued)

(58) Field of Classification Search

CPC ..... A41G 3/00; A61K 7/06; B05D 1/28
USPC ..... 424/47; 427/2.31
See application file for complete search history.

(56) References Cited

U.S. PATENT DOCUMENTS

| | | | | |
|---|---|---|---|---|
| 2004/0042975 | A1* | 3/2004 | Streuli et al. | 424/47 |
| 2010/0275939 | A1* | 11/2010 | Shinbayashi | 132/53 |

FOREIGN PATENT DOCUMENTS

| | | | |
|---|---|---|---|
| JP | 2005299036 | A | 10/2005 |
| KR | 20070050147 | A | 5/2007 |
| KR | 101039043 | B1 | 6/2011 |

*Primary Examiner* — Dah-Wei D Yuan
*Assistant Examiner* — Andrew Bowman
(74) *Attorney, Agent, or Firm* — The Webb Law Firm

(57) ABSTRACT

An artificial hair filament having a core/sheath structure is provided. The artificial hair filament has excellent antibacterial and antifungal effects since antibacterial and antifungal nanoparticles are included in the sheath structure of the artificial hair filament. Here, the antibacterial and antifungal effects can last for a long period of time. A contact-type drug-treating roller and an ultrasonic spraying machine can be used to provide the artificial hair filament with the antibacterial and antifungal effects. In the artificial hair filament, the sheath structure is formed so that the sheath structure occupies 5 to 20% of an entire filament diameter, thereby exhibiting desirable antibacterial and antifungal effects. Therefore, degradation of the antibacterial properties and antifungal properties with time can be prevented.

7 Claims, 2 Drawing Sheets

(51) Int. Cl.

| | |
|---|---|
| ***D06M 23/02*** | (2006.01) |
| ***D06M 23/06*** | (2006.01) |
| ***D06M 23/08*** | (2006.01) |
| ***D06B 11/00*** | (2006.01) |
| *D01F 1/10* | (2006.01) |
| *D01F 8/06* | (2006.01) |
| *D01F 8/12* | (2006.01) |
| *D01F 8/14* | (2006.01) |
| *D01F 8/16* | (2006.01) |
| *A41G 3/00* | (2006.01) |
| *D06M 101/20* | (2006.01) |
| *D06M 101/32* | (2006.01) |
| *D06M 101/34* | (2006.01) |

(52) U.S. Cl.
CPC ..... *D06M 2101/20* (2013.01); *D06M 2101/32* (2013.01); *D06M 2101/34* (2013.01)

ARTIFICIAL HAIR FILAMENT HAVING ANTIBACTERIAL AND ANTIFUNGAL PROPERTIES, METHOD AND DEVICE FOR PREPARING THE SAME

CROSS-REFERENCE TO RELATION APPLICATIONS

This application is a continuation-in-part of U.S. application Ser. No. 13/351,505 filed Jan. 17, 2012, which claims priority to Korean Patent Application No. 10-2011-0119684 filed on Nov. 16, 2011, the entire disclosures of which are incorporated herein by reference in their entireties.

BACKGROUND OF THE INVENTION

1. Field of the Invention

The present invention relates to an artificial hair filament having antibacterial and antifungal properties, and a method and device for preparing the same, wherein the artificial hair filament has a sheath/core-type complex structure.

2. Discussion of Related Art

With the improved and stabilized standard of living, there is a growing population who uses artificial hair for beauty. Since artificial hair is transplanted in a user's scalp or glued to the user's scalp, it is contaminated with sweat secreted from a human body, heat, dust from external environments, and impurities, or contaminated with bacteria, and fungi. These contaminations have adverse effects on the user's hygiene and health. Therefore, the artificial hair should be prepared to have antibacterial and antifungal effects.

In recent years, a variety of antibacterial materials have been widely used to develop and produce an artificial hair filament having antibacterial and antifungal effects (Korean Patent Publication No. 10-2007-0050147).

However, the artificial hair filament prepared using an antibacterial material has a problem in that it shows considerably degraded antibacterial and antifungal effects due to its poor durability when it is washed several times. Also, some artificial hair filaments prepared as known in the art show antibacterial and antifungal effects, but some do not show antibacterial and antifungal effects. As a result, they have a problem in that their antibacterial and antifungal effects are not uniformly controlled. Therefore, there is an urgent demand to develop an artificial hair filament showing excellent and long-lasting antibacterial and antifungal effects.

Also, since most antibacterial materials include an inorganic material, the inorganic material accumulates in a spinneret during use of a spinning machine, which leads to an increase in internal pressure of the spinneret. Also, filaments may be cut when the internal pressure of the spinneret is very high.

Meanwhile, a post-processing method includes a method of providing an artificial hair filament with antibacterial and antifungal properties. As such a method, a dipping method and a spraying method have been generally performed. A double-dipping method generally includes passing an artificial hair filament through a tank carrying a drug, removing an excessive amount of the drug under a constant pressure using a device such as a roller and subjecting the artificial hair filament to a process such as heat treatment. Although such a process has an advantage in that it is possible to treat an entire surface of a filament with a drug, it has a problem in that it is difficult to increase a concentration of the drug, and also the drug attached to a surface of the fiber may be detached during removal of an excessive amount of the drug, which makes it difficult to perform uniform treatment. Meanwhile, the spraying method is a widely used method which includes spraying a drug under an air pressure to treat a surface of a fiber with the drug. Although such a method may be carried out using simple equipment, it has problems in that it is difficult to uniformly treat an entire surface of a filament with a drug since large droplets are formed when the drug is sprayed under an air pressure, and a lower portion of the filament is not treated with the drug since an upper portion of the filament is generally treated with the drug.

SUMMARY OF THE INVENTION

The present invention is directed to a method of preparing an artificial hair filament having antibacterial and antifungal functions which are maintained at a constant level and last for a long period of time, and an artificial hair filament prepared using the method.

Also, the present invention is directed to a device used to prepare an artificial hair filament having excellent antibacterial and antifungal effects.

According to an aspect of the present invention, there is provided a method of preparing an artificial hair filament. Here, the method includes coating a filament with an antibacterial and antifungal drug. In this case, the filament may be spun from at least one resin selected from the group consisting of a polyolefin, a polyester and a polyamide, and the coating may start from a lower portion of the filament using a contact-type drug-treating roller, and an upper portion of the filament using an ultrasonic spraying machine.

The filament may be fed by a feed roller, and wound around a winding roller after the filament is coated with the antibacterial and antifungal drug.

The filament may be bent at an angle of 3 to 10° by a tension-adjusting roller before the filament is coated with the antibacterial and antifungal drug.

The filament coated with the antibacterial and antifungal drug may be heat-treated at a temperature of 150 to 200° C.

The antibacterial and antifungal drug may have a concentration of 0.05 to 2% by weight and a viscosity of 10 to 50 cps.

The ultrasonic spraying machine may have an air pressure of 1 to 5 kg/cm$^2$.

The antibacterial and antifungal drug may include a nanoparticle component having antibacterial and antifungal properties.

The antibacterial and antifungal drug may include a binder selected from the group consisting of a polyurethane-based resin, an acrylic resin, a silicone-based resin, a melamine-based resin, an epoxy-based resin, and a mixture thereof.

According to another aspect of the present invention, there is provided a device for preparing an artificial hair filament. Here, the device includes a feed roller configured to feed a filament, a tension-adjusting roller configured to bend the filament fed from the feed roller at an angle of 3 to 10° in a traveling direction thereof, an ultrasonic spraying machine configured to spray an antibacterial and antifungal drug on the filament passed through the tension-adjusting roller by allowing the spraying to start from an upper portion of the filament, a contact-type drug-treating roller configured to coat the filament passed through the tension-adjusting roller with the antibacterial and antifungal drug by allowing the coating to start from a lower portion of the filament, a heat treatment machine configured to heat-treat the antibacterial and antifungal drug at a temperature of 150 to 200° C., and a winding roller configured to wind the heat-treated filament.

According to still another aspect of the present invention, there is provided an artificial hair filament having a core structure and a sheath structure. Here, the core structure is formed of a filament spun from at least one resin selected from the group consisting of a polyolefin, a polyester and a polyamide, and the sheath structure is formed by coating the filament with an antibacterial and antifungal drug, wherein the coating starts from a lower portion of the filament using a contact-type drug-treating roller, and an upper portion of the filament using an ultrasonic spraying machine.

In this case, the sheath structure may occupy 5 to 20% of a filament diameter.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

The present invention is directed to an artificial hair filament having a sheath/core-type structure. Here, the sheath structure is prepared by coating a surface of the core structure with a drug for providing a filament with antibacterial and antifungal effects.

The filament constituting the core structure is preferably spun from at least one resin selected from the group consisting of a polyolefin, a polyester and a polyamide.

Also, the drug constituting the sheath structure includes a nanoparticle component having antibacterial and antifungal properties so as to exhibit the antibacterial and antifungal effects. According to one exemplary embodiment, the nanoparticle component includes a silver component. When such a nanoparticle component is included and used in the sheath structure of the artificial hair filament, the nanoparticle component shows excellent antibacterial and antifungal effects. Therefore, the artificial hair filament according to one exemplary embodiment of the present invention has an advantage in that the antifungal and antibacterial activities are excellently maintained and lasted for a long period of time.

In the drug for exhibiting desirable antibacterial and antifungal effects, a concentration (also referred to as "content") of the nanoparticle component is in a range of 0.05 to 2% by weight, and water is preferably used as a solvent of the drug. To thermally fix a drug as will be described later, the drug may also further include a binder selected from the group consisting of a polyurethane-based resin, an acrylic resin, a silicone-based resin, a melamine-based resin, an epoxy-based resin, and a mixture thereof. The binder is included at a content of 5 to 15% by weight, preferably 10 to 12% by weight. Also, a viscosity of the drug is in a range of 10 to 50 cps, preferably 20 to 30 cps.

Figure 1:
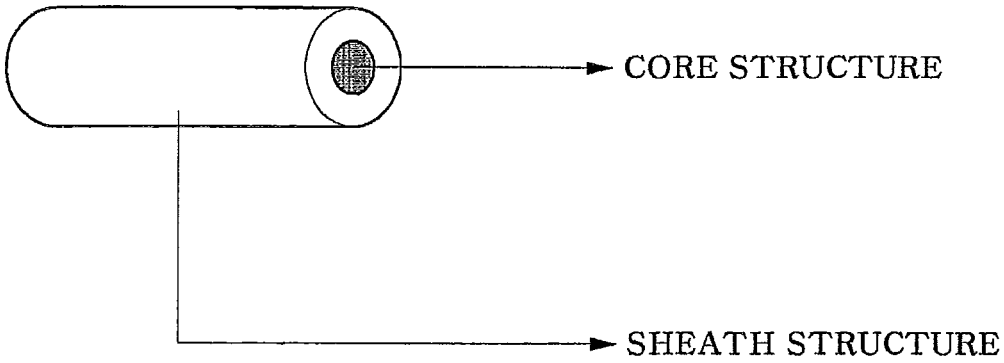
FIG. 1 is a configuration diagram showing an artificial hair filament according to one exemplary embodiment of the present invention.

The artificial hair filament according to one exemplary embodiment of the present invention has a core structure spun composed of the filament spun from at least one resin selected from the group consisting of a polyolefin, a polyester and a polyamide, and a sheath structure surrounding a surface of the core structure, as shown in FIG. 1. In this case, the sheath structure is formed by coating the core structure with an antibacterial and antifungal drug.

In the filament having a sheath/core-type structure according to one exemplary embodiment of the present invention, the sheath structure is preferably formed so that the sheath structure can occupy 5 to 20%, and more preferably 10 to 15%, of a filament diameter. That is, when the sheath structure is formed by surrounding a surface of the core structure, the antibacterial and antifungal effects are excellently maintained and last for a long period of time.

For this reason, the present invention provides a method of preparing an artificial hair filament including coating a filament with an antibacterial and antifungal drug. Here, the filament may be spun from at least one resin selected from the group consisting of a polyolefin, a polyester and a polyamide, and the coating may start from a lower portion of the filament using a contact-type drug-treating roller, and start from an upper portion of the filament using an ultrasonic spraying machine.

The method of preparing an artificial hair filament will be described in further detail with reference to FIG. 2.

The artificial hair filament is wound around a feed roller 100 in the form of a bundle, unwound at a constant rate, and then transferred to a processing machine. Next, the artificial hair filament is brought into contact with a lower portion of a tension-adjusting roller 300, and passed through an upper portion of a contact-type drug-treating roller 400 that is a contact-type drug-treating roller. In this case, the upper surface of the contact-type drug-treating roller 400 is disposed at a higher position than the lower surface of the tension-adjusting roller 300, and thus the artificial hair filament may be bent at a predetermined angle in a traveling direction. When the artificial hair filament is bent at this angle, tension is applied to the artificial hair filament. As a result, attachment of an excessive amount of a drug may be prevented even when the artificial hair filament is brought into contact with the contact-type drug-treating roller 400. The angle at which the artificial hair filament is bent is in range of 3 to 10°, preferably 5°. When the angle at which the artificial hair filament is bent exceeds 10°, excessive tension may be placed on the artificial hair filament, which leads to deformation of the artificial hair filament. On the other hand, when the angle is less than 3°, the artificial hair filament may be coated with an excessive amount of the drug using the contact-type drug-treating roller 400 since the artificial hair filament is less tight.

Also, since an ultrasonic spraying machine 500 is installed at a position in which the contact-type drug-treating roller 400 is disposed, the drug may be finely sprayed to coat an upper portion of the artificial hair filament. Conventional equipment is used herein as an ultrasonic wave generator, and an air pressure in the equipment is adjusted to approximately 1 to 5 $kg/cm^2$, preferably approximately 3 $kg/cm^2$.

A concentration of the drug used in the contact-type drug-treating roller 400 and the ultrasonic spraying machine 500 is in a range of 0.05 to 2% by weight, and a viscosity of the drug is in a range of 10 to 50 cps, preferably 20 to 30 cps.

The artificial hair filament treated with the drug is input to a heat treatment machine 600. In this case, the heat treatment machine has a high internal temperature of 150 to 200° C., and thus may fix the drug. The heat-treated artificial hair filament is wound around a winding roller 800 at a high temperature, and then developed into a product.

Also, the present invention provides a device for preparing an artificial hair filament. The device includes a feed roller configured to feed a filament, a tension-adjusting roller configured to bend the filament fed from the feed roller at an angle of 3 to 10° in a traveling direction thereof, an ultrasonic spraying machine configured to spray an antibacterial and antifungal drug on the filament passed through the tension-adjusting roller by allowing the spraying to start from an upper portion of the filament, a contact-type drug-treating roller configured to coat the filament passed through the tension-adjusting roller with the antibacterial and antifungal drug by allowing the coating to start from a lower portion of the filament, a heat treatment machine configured to heat-treat the antibacterial and antifungal drug at a temperature of 150 to 200° C., and a winding roller configured to wind the heat-treated filament.

The artificial hair filament prepared using the device and method for preparing an artificial hair filament has a core structure and a sheath structure. Here, the core structure may be formed of a filament spun from at least one resin selected from the group consisting of a polyolefin, a polyester and a polyamide, and the sheath structure may be formed by coating the filament with the antibacterial and antifungal drug. In this case, the coating may start from a lower portion of the filament using the contact-type drug-treating roller, and start from an upper portion of the filament using the ultrasonic spraying machine, and the sheath structure occupies 5 to 20% of an entire filament diameter of the artificial hair filament.

Hereinafter, the present invention will be described in further detail with reference to the following Examples. However, it should be understood that the description proposed herein is only a preferable example for the purpose of illustrations only, and not intended to limit the scope of the invention.

Example 1

Figure 2:
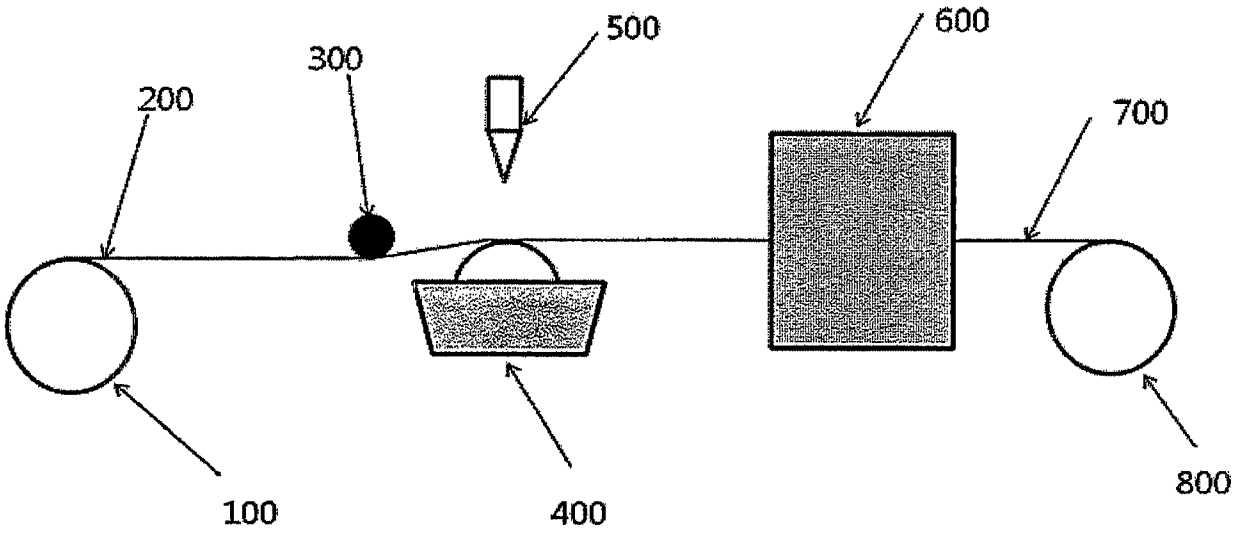
FIG. 2 is a schematic view showing a device for preparing an artificial hair filament according to one exemplary embodiment of the present invention.

In the case of the device as shown in FIG. 2, a polyester-based artificial hair filament 200 was wound around a feed roller 100. Then, a lower portion of the artificial hair filament 200 was coated with an antibacterial and antifungal drug using a contact-type drug-treating roller 400, and an upper portion of the artificial hair filament 200 was coated with the antibacterial and antifungal drug using an ultrasonic spraying machine 500 while unwinding the artificial hair filament 200 from the feed roller 100. Thereafter, the antibacterially and antifungally treated filament 700 was wound around a winding roller 800 by passing the coated artificial hair filament 200 through a heat treatment machine 600 whose inner part was heated at 180° C. In this case, before the filament is input to the contact-type drug-treating roller 400, the filament was bent upwards at an angle of 5° to be provided with tension while passing through the tension-adjusting roller 300, and the drug discharged from the ultrasonic spraying machine 500 was sprayed downward at a pressure of 3 kg/cm$^2$. Also, the concentration of the antibacterial and antifungal drug used in the contact-type drug-treating roller 400 and the ultrasonic spraying machine 500 was 0.5% by weight, and the viscosity was 25 cps. An acrylic binder was added at a content of 10% by weight to the antibacterial and antifungal drug, and the drug-treated artificial hair filament was passed through the heat treatment machine 600 whose internal temperature was set to 180° C., and a time required to pass through the heat treatment machine 600 was 1 minute. The artificial hair filament passed through the heat treatment machine 600 was wound around the winding roller 800, and then evaluated for antibacterial properties and antifungal properties.

Comparative Example 1

A polyethylene terephthalate (PET) resin having an intrinsic viscosity of 0.64 was dried, melted at 280° C. in a conventional melt extruder, and spun using a spinneret. An antibacterial and antifungal agent had been added to the PET resin at a content of 0.5% by weight based on the total weight of the resin. The resulting filament was generally elongated, heat-treated and wound to prepare an artificial hair filament. The prepared filament was evaluated for antibacterial and antifungal properties.

Comparative Example 2

A polyester-based artificial hair filament was dipped in an antibacterial and antifungal agent using a conventional post-processing method, and squeezed to remove the drug attached to a surface of the filament. Then, the artificial hair filament was heat-treated. In this case, the antibacterial and antifungal agent was used at a content of 0.5% by weight, and the acrylic binder was used together at a content of 10% by weight. The heat treatment was performed at a temperature of 180° C., and the heat-treated artificial hair filament was evaluated for antibacterial and antifungal properties.

Comparative Example 3

A commercially available polypropylene artificial hair filament (Serim Fiber Co., Ltd.) was used in this Comparative Example.

Comparative Example 4

A commercially available PET artificial hair filament (Company A as an artificial hair filament producer in Korea) was used in this Comparative Example.

The artificial hair filaments prepared in Comparative Examples were evaluated for antibacterial and antifungal properties.

<Antibacterial Properties>

The antibacterial properties were evaluated in a test strain (*Escherichia coli* ATCC 8739) according to the JIS L 1902 standard. A medium of the test strain was incubated at 35±1° C. and RH 90±5% for 24 hours, and the test strain was counted to obtain an antibacterial rate.

<Antifungal Properties>

The antifungal properties were evaluated in a sample including 5 mixed strains according to the ASTM G-21 standard by determining a level of growth of the mixed strains.

Fungal strains (mixed strains)

*Aspergillus niger* ATCC 9642

*Penicillium pinophilum* ATCC 11797

*Chaetomium globosum* ATCC 6206

*Gliosiadiun virens* ATCC 9645

*Aureobasidium pullulans* ATCC 10233

The artificial hair filaments prepared in Examples and Comparative Examples 1 to 4 were evaluated for antibacterial and antifungal properties. The results are listed in the following Table 1.

TABLE 1

| Items | Antibacterial rate (%) | Antifungal test Incubation time | | | |
|---|---|---|---|---|---|
| | | After one week | After two weeks | After three weeks | After four weeks |
| Example 1 | 99.9 | 0 | 0 | 0 | 0 |
| Comparative Example 1 | 93.6 | 0 | 1 | 2 | 3 |
| Comparative Example 2 | 73.6 | 0 | 0 | 1 | 2 |
| Comparative Example 3 | 23.4 | 1 | 2 | 2 | 3 |
| Comparative Example 4 | 32.6 | 2 | 3 | 3 | 3 |

<Criteria for Evaluation of Antifungal Test>

0: Growth of hypha is not observed in a region in which a test sample is inoculated.

1: Growth of hypha is observed on a test sample at a ratio of less than 10%.

2: Growth of hypha is observed on a test sample at a ratio of 10 to 30%.

3: Growth of hypha is observed on a test sample at a ratio of 30 to 60%.

4: Growth of hypha is observed on a test sample at a ratio of more than 60%.

As seen from the results, it was confirmed that the artificial hair filament prepared using the device and method according to the present invention showed excellent and long-lasting antibacterial and antifungal properties.

According to the present invention, since the nanoparticle component having antibacterial and antifungal functions is included in the sheath structure, the artificial hair filament having excellent and long-lasting antibacterial and antifungal effects can be prepared.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A method of preparing an artificial hair filament, comprising:

coating a filament with an antibacterial and antifungal drug, wherein the filament is spun from at least one resin selected from the group consisting of a polyolefin, a polyester and a polyamide, and the coating starts from a lower portion of the filament using a contact drug-treating roller, and an upper portion of the filament using an ultrasonic spraying machine, wherein the filament is bent at an angle of 3 to 10° by a tension-adjusting roller before the filament is coated with the antibacterial and antifungal drug.

2. The method of claim 1, wherein the filament is fed by a feed roller, and wound around a winding roller after the filament is coated with the antibacterial and antifungal drug.

3. The method of claim 1, wherein the filament coated with the antibacterial and antifungal drug is heat-treated at a temperature of 150 to 200° C.

4. The method of claim 1, wherein the antibacterial and antifungal drug has a concentration of 0.05 to 2% by weight and a viscosity of 10 to 50 cps.

5. The method of claim 1, wherein the ultrasonic spraying machine has an air pressure of 1 to 5 $kg/cm^2$.

6. The method of claim 1, wherein the antibacterial and antifungal drug comprises a nanoparticle component having antibacterial and antifungal properties.

7. The method of claim 1, wherein the antibacterial and antifungal drug comprises a binder selected from the group consisting of a polyurethane-based resin, an acrylic resin, a silicone-based resin, a melamine-based resin, an epoxy-based resin, and a mixture thereof.

* * * * *